United States Patent [19]

Karle

[11] 3,963,228

[45] June 15, 1976

[54] DRILL STRING SHOCK ABSORBER

[75] Inventor: Arun P. Karle, Houston, Tex.

[73] Assignee: Schlumberger Technology Corporation, New York, N.Y.

[22] Filed: Dec. 23, 1974

[21] Appl. No.: 535,525

[52] U.S. Cl. ..... 267/166; 267/125; 64/23; 64/4 R

[51] Int. Cl.[2] ..... F16F 1/06

[58] Field of Search ..... 267/166, 125, 174, 170; 64/11 R, 23, 13; 175/321

[56] References Cited

UNITED STATES PATENTS

| | | | |
|---|---|---|---|
| 3,033,011 | 5/1962 | Garrett | 64/11 R |
| 3,122,902 | 3/1964 | Blair et al. | 64/23 |
| 3,858,669 | 1/1975 | Jeter | 64/23 |

*Primary Examiner*—James B. Marbert
*Attorney, Agent, or Firm*—David L. Moseley; William R. Sherman; Stewart F. Moore

[57] ABSTRACT

In accordance with an illustrative embodiment of the present invention as disclosed herein, a shock absorber adapted to be incorporated in a drill string includes axially splined housing and mandrel members having a helical coil spring reacting therebetween to absorb longitudinal vibration and shock loads and otherwise attenuate exciting forces generated by the drill bit. The coil spring has a low spring rate and is enclosed between the housing and a hollow flow tube that is slidably sealed with respect to the housing and the mandrel.

9 Claims, 3 Drawing Figures

DRILL STRING SHOCK ABSORBER

Figure 1:
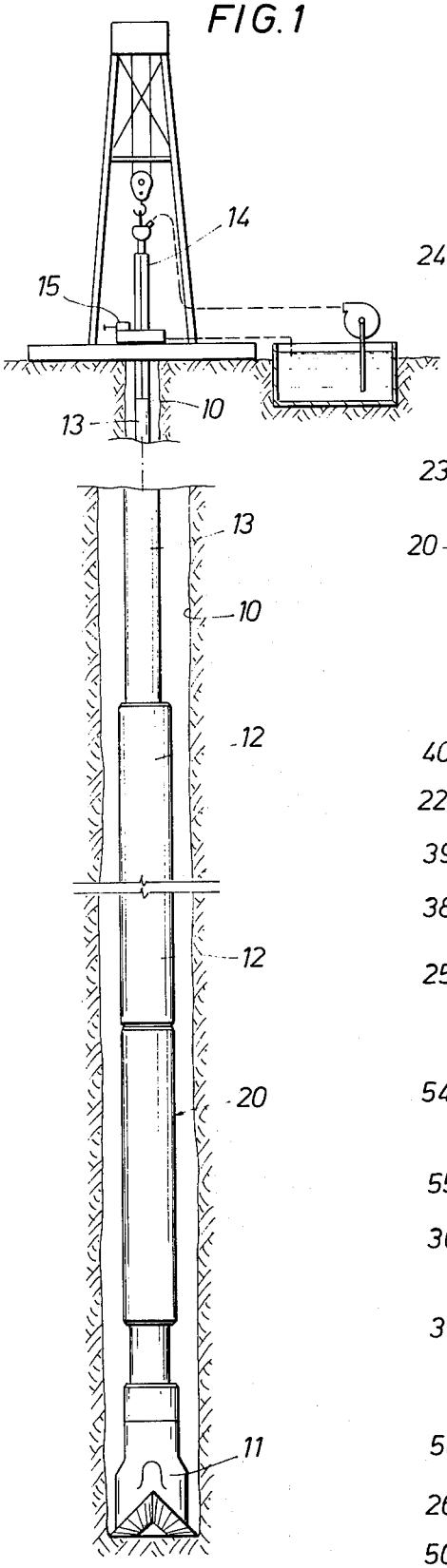

This invention relates generally to well drilling tools, and particularly to a new and improved apparatus adapted for use above a drill bit to absorb and attenuate vibration and shock loads generated by the drilling action of the bit.

In rotary drilling, it is typical to employ a multi-cone bit at the lower end of a drill collar string which is suspended from the lower end of a drill pipe extending upwardly to the surface. The entire string and the bit are rotated by a kelley and drive works at the surface to cause the bit cones to pulverize the rock and other earther formations. Drilling fluid or "mud" is pumped down the drill string and out of orifices in the bit and returns to the surface via the well annulus to cool the bit, clean the borehole bottom and to carry cuttings to the surface.

The action of a cone-type bit as it advances through rock and the like produces a substantial amount of longitudinal vibration, shock loads and other cyclical exciting forces which accelerate wear and other damage to both the bit and the drill string thereabove, as well as impeding the rate of penetration of the bit. Various attempts have been made to solve such problems by incorporating a shock absorbing device above the bit. Some prior devices utilize a rubber cushion as the absorbing or damping element, however rubber tends to break down and extrude fairly readily and must therefore be replaced quite often to maintain an operable system. Moreover, the use of rubber or rubber-like material in a substantially confined space has resulted in an extremely high spring rate which is considered to be undesirable. Other devices have employed a compressible gas or the like, which is difficult to maintain confined within the tool over an extended period of time, and which also provides a relatively high spring rate particularly when used at considerable depths.

It is an object of the present invention to provide a new and improved attenuating and shock absorbing apparatus for use in a rotary drill string above the bit.

A more specific object of the present invention is to provide a new and improved shock load and vibration absorbing device of the type described which utilizes an elongated helical coil spring that provide a low spring rate which is much more effective in reducing wear on the bit and the drill string and in increasing the rate of penetration of the bit.

These and other objects are attained in accordance with the concepts of the present invention through the provision of an apparatus comprising mandrel and housing members coupled together for limited longitudinal relative movement and slidably splined to prevent relative rotation. To provide a yieldable resistance to such longitudinal relative movement, an elongated helical coil spring of rectangular section has one end fixed to the mandrel and the other end fixed to the housing so as to react in a resilient manner therebetween. A hollow flow tube is sealingly slidable with respect to the housing and the mandrel and defines wall surfaces of a chamber which encloses the coil spring and contains a suitable lubricating oil. The oil moves through restricted flow passages provided by the splines to damp out peak load changes, and the flow tube transmits the pressures of drilling fluids flowing through the apparatus to the enclosed oil so that such pressures can act on the mandrel and tend to cause telescoping extension of the members in opposition to the drilling weight.

Figure 2A:
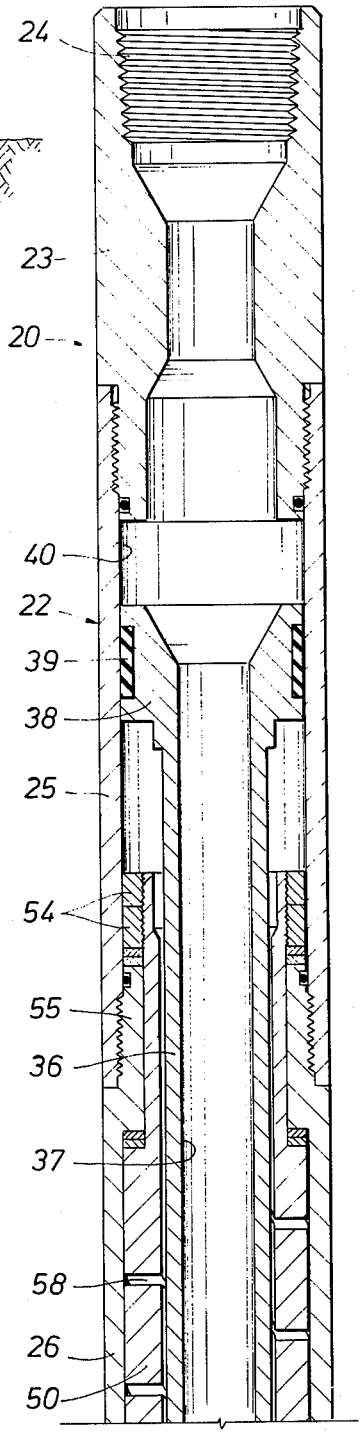
Figure 2B:
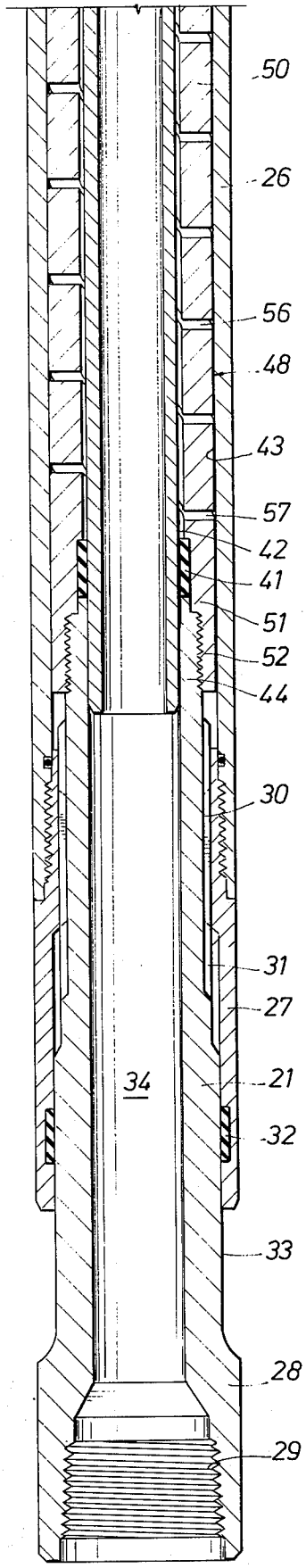

The present invention has other objects and advantages which will become more clearly apparent in connection with the following detailed description of a preferred embodiment thereof, taken in conjunction with the appended drawings, in which:

FIG. 1 is a schematic illustration of a well drilling operation employing rotary drilling techniques; and FIGS. 2A and 2B are longitudinal sectional views of the a apparatus of the present invention, FIG. 2B forming a lower continuation of FIG. 2A.

Referring initially to FIG. 1, there is shown schematically a borehole 10 being drilled into the earth using typical rotary drilling techniques. A drill bit 11 is attached to the lower end of a drill string which includes relatively heavy drill collars 12 at the lower end to weight the bit, and drill pipe 13 extending upwardly to the surface where it is attached to a kelley 14 that is driven by a rotary 15 in order to spin the entire drill string and the bit 11. A drilling fluid is pumped down the drill string and passes into the bottom of the borehole through orifices in the bit 11, and circulates back to the surface via the annulus between the drill string and the borehole wall. The drilling fluid cools the bit, scavanges the hole bottom and carries cuttings up to the surface and provides a hydrostatic head which keeps liquids and gas in the formations penetrated by the bit from coming into the borehole.

A conventional drill bit 11 employs a plurality of rotatable cutting cones having teeth that chip and eat away at the bottom of the borehole 10 as the bit is rotated. The drilling action of the bit 11 under the weight of the drill collars 12 generates a considerable amount of vibration and shock loads which are attenuated by the incorporation of an apparatus 20, the subject of the present invention, which is connected between the lower end of the drill collars 12 and the bit 11.

Referring now to FIGS. 2A and 2B for an illustration of a preferred embodiment of the present invention, the drill string shock absorber apparatus 20 includes a mandrel 21 extending upwardly within the lower end of a tubular housing assembly 22. The housing assembly 22 may include several threadedly interconnected sections such as an upper sub 23 having internal threads 24 for connecting to the lower end of the drill collars 12, upper and lower intermediate sections 25 and 26, and a lower spline and seal sub 27. The mandrel 21 has a lower box 28 with internal threads 29 adapted for connection to the drill bit 11, and is telescopically disposed for limited longitudinal movement relative to the housing assembly 22. Longitudinally extending spline ribs 30 extending inwardly of the sub 27 are in mesh with companion spline grooves 31 on the mandrel 21 in order to prevent relative rotation. A seal packing assembly 32 of suitable construction is carried by the sub 27 and is sealingly slidable on the outer periphery 33 of the mandrel 21 above the threaded box 28 to prevent leakage of fluid.

An elongated hollow tube 36 having a through bore 37 for the passage of drilling fluids is positioned within the housing assembly 22 and has an enlarged diameter upper end section 38 that carries a packing assembly 39 which is sealingly slidable against the inner wall surface 40 of the housing section 25. In addition, another packing assembly 41 which may be located at the upper end of the mandrel 21 seals against the outer wall surface 42 of the tube 36 to provide an elongated annular cavity 43 between the upper section 38 of the tube and the upper end portion 44 of the mandrel.

A resilient structure indicated generally at 48 is disposed within the cavity 43 to afford a yieldable resistance to relative longitudinal movement of the mandrel 21 and the housing assembly 22. The structure 48 in a preferred form comprises a cylindrical helical coil spring 50 of rectangular cross-section, the spring having its lower end portion 51 fixed to the upper end of the mandrel 21 by threads 52, and its upper end portion 53 fixed with respect to the housing sections 25 and 26 by lock nuts 54 which engage above an inwardly directed shoulder 55 on the housing. The spring 50 may be manufactured from a length of thick-walled pipe stock by milling at least one helical groove 56 through the wall from a point 57 near the lower end to a point 58 near the upper end, providing a resultant resilient member with a relatively low spring rate. The interior spaces in the cavity 43 and those between the spline sub 27 and the mandrel 21 are filled with a suitable lubricant such as silicone oil which is confined within a volume whose boundaries are defined in part by the packing assemblies 39, 41 and 32. The pressure of the oil will be substantially the same as that of the drilling fluids inside the tool because the tube 36 is free floating. Moreover it will be appreciated that the oil moves through the space between the splines 30, 31 during relative longitudinal movement to provide a dashpot effect as will be discussed more fully herebelow.

In operation, the apparatus 20 is assembled as shown in the drawings and the interior spaces between the mandrel 21, the housing 22 and the tube 36 are filled with lubricating oil through a suitable port (not shown). The apparatus then is connected in the drill string between the lower end of the drill collars 12 and the bit 11 and lowered with the drill string into the borehole. When the bit 11 lands on the bottom, the mandrel 12 will move upwardly somewhat within the housing as the weight of the drill collar is applied thereto, and as mud circulation is initiated by the surface pumps a fluid pressure equal to the pressure drop across the bit orifices is transmitted to the lubricating oil in the cavity 43 by the piston section 38 at the upper end of the tube 36. This pressure acts downwardly on the mandrel 21 over a transverse cross-sectional area defined by the difference in seal diameters for the packing assemblies 32 and 41, with the result that the mandrel 21 will occupy a position midway between the limits of its longitudinal travel relative to the housing 22. Then as the drill string and the bit 11 are turned by the rotary 15, shock loads, vibration and other exciting forces generated by the bit 11 are absorbed by the resilient action of the helical coil spring 50. Peak loads are damped out by the dashpot effect of restricted oil flow past the splines 30 and 31 during relative longitudinal movement.

It now will be recognized that a new and improved drill string shock absorbing apparatus has been provided. The mechanical coil spring 48 provides as a resilient structure with a low spring rate which is much more effective and reliable in attenuating the exciting forces generated by the bit than has heretofore been used in devices employing an elastomer or a compressible gas. The fluid pressure drop across the drill bit is effectively used in opposition to the drilling weight to enable the mandrel and housing to telescope readily as shock loads and vibrations are absorbed.

Since certain changes or modifications may be made in the disclosed embodiment without departing from the inventive concepts involved, it is the aim of the appended claims to cover all such changes and modifications falling within the true spirit and scope hereof.

I claim:

1. A shock absorber apparatus for use in a drill string, comprising: telescopically disposed and slidably splined mandrel and housing members, one of said members being adapted for attachment to a drill string and the other of said members being adapted for attachment to a drill bit; an elongated, helical coil spring reacting between said members to absorb longitudinal vibrations and shock loads; and a hollow flow tube having one end portion sealingly slidable with respect to said housing member and another end portion sealingly slidable with respect to said mandrel member, said flow tube defining wall surfaces of a chamber that encloses said coil spring and contains a lubricating oil, said flow tube being arranged to transmit the pressures of a drilling fluid within said members to said oil.

2. The apparatus of claim 1 wherein said mandrel member has a transverse cross-sectional area that is subject to the pressure of said lubricating oil.

3. The apparatus of claim 2 further including spline means for preventing relative rotation of said housing and mandrel members, and fluid passage means extending past said spline means for conveying said oil during telescoping movement thereof in a manner to provide a dashpot effect to damp out peak load changes.

4. The apparatus of claim 3 further including coengageable seal means on said mandrel and housing means adjacent said spline means for preventing leakage of said oil to the exterior of said members.

5. The apparatus of claim 1 wherein said coil spring has a rectangular section and provides a relatively low spring rate.

6. A shock absorber apparatus for use in a drill string, comprising: an elongated tubular housing having its upper end adapted for connection to a drill string; a mandrel extending upwardly into the lower end of said housing and being sealingly slidable relative thereto; spline means for corotatively coupling said mandrel and said housing; an elongated hollow flow tube within said housing, said tube having an outwardly directed shoulder at its upper portion that is sealingly slidable with respect to said housing and an external seal surface on its lower portion that is sealingly slidable with respect to said mandrel, an intermediate portion of said flow tube being spaced inwardly of said housing to provide an annular cavity; and an elongated spring means positioned in said cavity and arranged to react between said housing and said mandrel to provide a yieldable resistance to longitudinal relative movement and thereby to substantially absorb and otherwise attenuate vibration and shock loads, said cavity and the interior spaces adjacent said spline means being filled with a lubricating oil.

7. The apparatus of claim 6 wherein said spring means is a helical coil of rectangular section constructed and arranged to provide a low spring rate.

8. The apparatus of claim 7 wherein said outwardly directed shoulder functions to transmit the pressure of drilling fluids within said apparatus to said lubricating oil, said mandrel having a transverse cross-section area subject to the pressure of said oil.

9. The apparatus of claim 8 wherein the clearance between said spline means provide restricted fluid passages for said oil during sliding movement of mandrel relative to said housing, thereby to provide a dashpot effect to substantially damp out peak load changes.

* * * * *